US009676593B2

(12) United States Patent
Zhao et al.

(10) Patent No.: US 9,676,593 B2
(45) Date of Patent: Jun. 13, 2017

(54) BELT INCLUDING FIBERS

(75) Inventors: Wenping Zhao, Glastonbury, CT (US); Gopal R. Krishnan, Wethersfield, CT (US); John P. Wesson, West Hartford, CT (US)

(73) Assignee: Otis Elevator Company, Farmington, CT (US)

( * ) Notice: Subject to any disclaimer, the term of this patent is extended or adjusted under 35 U.S.C. 154(b) by 156 days.

(21) Appl. No.: 14/414,633

(22) PCT Filed: Jul. 13, 2012

(86) PCT No.: PCT/US2012/046728
§ 371 (c)(1),
(2), (4) Date: Jan. 13, 2015

(87) PCT Pub. No.: WO2014/011187
PCT Pub. Date: Jan. 16, 2014

(65) Prior Publication Data
US 2015/0191330 A1 Jul. 9, 2015

(51) Int. Cl.
*B66B 7/06* (2006.01)
*D07B 1/22* (2006.01)
(Continued)

(52) U.S. Cl.
CPC ..... *B66B 7/062* (2013.01); *B66B 7/06* (2013.01); *D07B 1/22* (2013.01); *D07B 5/002* (2013.01); *D07B 5/005* (2013.01); *D07B 5/04* (2013.01); *D07B 2501/2007* (2013.01); *D10B 2321/02* (2013.01); *D10B 2331/02* (2013.01); *D10B 2331/021* (2013.01); *D10B 2331/04* (2013.01);
(Continued)

(58) Field of Classification Search
CPC ..... B66B 7/062
USPC ..... 428/76
See application file for complete search history.

(56) References Cited

U.S. PATENT DOCUMENTS 1,475,250 A 11/1923 Sundh
5,382,200 A 1/1995 Kimoto
(Continued)

FOREIGN PATENT DOCUMENTS

DE 3833527 4/1990
EP 0753471 A1 * 1/1997 ..... B65G 15/36
(Continued)

OTHER PUBLICATIONS

EP search report for EP12880934 dated Jul. 16, 2015.
CN search report for CN201280074700.4 dated Dec. 18, 2015.

*Primary Examiner* — Brent O'Hern
(74) *Attorney, Agent, or Firm* — O'Shea Getz P.C.

(57) ABSTRACT

A belt for an elevator system and a method for making the same is provided. The belt includes a plurality of tension members that extend along a length of the belt and a jacket. The jacket substantially retains the plurality of tension members. The jacket maintains a desired spacing and alignment of the tension members relative to each other. The jacket includes a plurality of first fibers and a plurality of second fibers. The jacket defines at least one exterior, traction surface of the belt. The first fibers are at least partially disposed between the tension members and the traction surface of the belt. The second fibers are fill fibers. The first fibers have at least one property that distinguishes them from the second fibers.

17 Claims, 3 Drawing Sheets

(51) Int. Cl.
*D07B 5/04* (2006.01)
*D07B 5/00* (2006.01)

(52) U.S. Cl.
CPC ..... *Y10T 29/49826* (2015.01); *Y10T 428/23* (2015.01); *Y10T 428/239* (2015.01)

(56) References Cited

U.S. PATENT DOCUMENTS

| | | | |
|---|---|---|---|
| 5,609,242 | A | 3/1997 | Hutchins et al. |
| 5,881,843 | A | 3/1999 | O'Donnell et al. |
| 6,086,500 | A | 7/2000 | Yamada et al. |
| 6,427,728 | B1 | 8/2002 | Maguire et al. |
| 6,431,221 | B1 | 8/2002 | Wrigley |
| 6,739,433 | B1 | 5/2004 | Baranda et al. |
| 6,772,797 | B2 | 8/2004 | Kikuchi |
| 7,121,306 | B2 | 10/2006 | Harrison |
| 7,304,006 | B2 | 12/2007 | Lee et al. |
| 7,341,076 | B2 | 3/2008 | Braejevelt et al. |
| 7,384,517 | B2 | 6/2008 | Watanabe et al. |
| 7,407,518 | B2 | 8/2008 | Bosman et al. |
| 7,523,626 | B2 | 4/2009 | Enzien et al. |
| 7,759,266 | B2 | 7/2010 | Hawkins et al. |
| 7,878,224 | B2 | 2/2011 | Quigley |
| 8,100,796 | B2 | 1/2012 | O'Donnell |
| 8,129,294 | B2 | 3/2012 | Khokar |
| 2007/0235595 | A1 | 10/2007 | Braekevelt et al. |
| 2010/0140022 | A1 | 6/2010 | Ach |
| 2011/0129647 | A1 | 6/2011 | Duke, Jr. et al. |
| 2011/0269588 | A1 | 11/2011 | Fleck et al. |

FOREIGN PATENT DOCUMENTS

| | | | | |
|---|---|---|---|---|
| EP | 2305591 | 4/2011 | | |
| KR | 2009111910 | 10/2009 | | |
| WO | 2011142756 | 11/2011 | | |
| WO | 2011142776 | 11/2011 | | |
| WO | WO 2011142756 A1 * | 11/2011 | ..... | B66B 7/062 |
| WO | WO2012039781 A1 | 3/2012 | | |

* cited by examiner

BELT INCLUDING FIBERS

This application is entitled to the benefit of, and incorporates by reference essential subject matter disclosed in PCT Application No. PCT/US2012/046728 filed on Jul. 13 2012.

BACKGROUND OF THE INVENTION

1. Technical Field

The present invention relates to belts, and more particularly to belts including fibers, for example used in elevator systems.

2. Background Information

Conventional traction elevator systems have included a car, a counterweight, two or more ropes interconnecting the car and the counterweight, and a machine and a traction sheave to move the ropes. The ropes were conventionally formed of steel wires formed into strands, the strands then formed into cords, and the cords then formed into the rope.

Although conventional ropes have proven to be very reliable and cost effective, other belts have been used in recent years as an alternative to the conventional ropes. Some belts have been designed with a plurality of steel cords within a jacket that includes fibers to suspend and/or lift the elevator car. There are significant advantages associated with such belts; however, it would still be desirable to provide such belts with improved properties (e.g., dimensional properties, mechanical properties, performance, durability, etc.), and at a reduced cost.

SUMMARY OF THE DISCLOSURE

According to an aspect of the invention, a belt for an elevator system is provided. The belt includes a plurality of tension members and a jacket. The tension members extend along a length of the belt. The jacket substantially retains the plurality of tension members. The jacket includes a plurality of first fibers and a plurality of second fibers. The jacket defines at least one exterior, traction surface of the belt. The first fibers are at least partially disposed between the tension members and the traction surface of the belt. The second fibers are fill fibers. The first fibers have at least one property that distinguishes them from the second fibers.

Alternatively or in addition to this or other aspects of the invention, the at least one property is selected from the group of mechanical properties consisting of: tenacity, linear density, linear modulus, durability.

Alternatively or in addition to this or other aspects of the invention, the tenacity or linear density of the first fibers is greater than the tenacity or linear density of the second fibers, respectively.

Alternatively or in addition to this or other aspects of the invention, the at least one property is the diameter of the first fibers.

Alternatively or in addition to this or other aspects of the invention, the at least one property is selected so that the belt has at least one predetermined property.

Alternatively or in addition to this or other aspects of the invention, the at least one predetermined property of the belt is selected from the group consisting of: dimension, density, strength, modulus, traction, durability, and performance.

Alternatively or in addition to this or other aspects of the invention, the first fibers are selected from the group consisting of: weft fibers, or warp fibers.

Alternatively or in addition to this or other aspects of the invention, the jacket totally covers the plurality of tension members.

Alternatively or in addition to this or other aspects of the invention, the traction surface of the belt is defined by exposed portions of the first fibers, and exposed portions of the second fibers.

Alternatively or in addition to this or other aspects of the invention, the at least one property is selected so that a pressure distribution on the traction surface of the belt is substantially uniform when the belt engages a sheave of the elevator system.

Alternatively or in addition to this or other aspects of the invention, an orientation of one of the first fibers or the second fibers relative to the tension members is selected so that a pressure distribution on the traction surface of the belt is substantially uniform when the belt engages a sheave of the elevator system.

Alternatively or in addition to this or other aspects of the invention, the first fibers or the second fibers are yarns.

Alternatively or in addition to this or other aspects of the invention, at least one of the first fibers or the second fibers are made from a material selected from the group consisting of: a polyester, a polyamide, an aramid, a polyolefin.

Alternatively or in addition to this or other aspects of the invention, the second fibers extend along the tension member in a lengthwise direction, and are not disposed between the tension members and the traction surface.

Alternatively or in addition to this or other aspects of the invention, the at least one property is selected so that an exterior surface of the belt has at least one predetermined property.

Alternatively or in addition to this or other aspects of the invention, the at least one predetermined property of the exterior surface of the belt is selected from the group consisting of: dimension, density, strength, modulus, traction, durability, and performance.

Alternatively or in addition to this or other aspects of the invention, the exterior surface of the belt is the traction surface of the belt.

Alternatively or in addition to this or other aspects of the invention, the exterior surface of the belt is a non-traction surface of the belt.

According to another aspect of the invention, a method for manufacturing a belt for an elevator system is provided. The method includes the steps of: (a) providing a plurality of lengthwise-extending tension members; and (b) substantially retaining the plurality of tension members with a jacket. The jacket includes a plurality of first fibers and a plurality of second fibers. The jacket defines at least one exterior, traction surface of the belt. The first fibers are at least partially disposed between the tension members and the traction surface of the belt. The second fibers are fill fibers. The first fibers have at least one property that distinguishes them from the second fibers.

These and other objects, features and advantages of the present invention will become more apparent in light of the following detailed description of preferred embodiments thereof, as illustrated in the accompanying drawings.

DETAILED DESCRIPTION OF THE INVENTION

Figure 1:
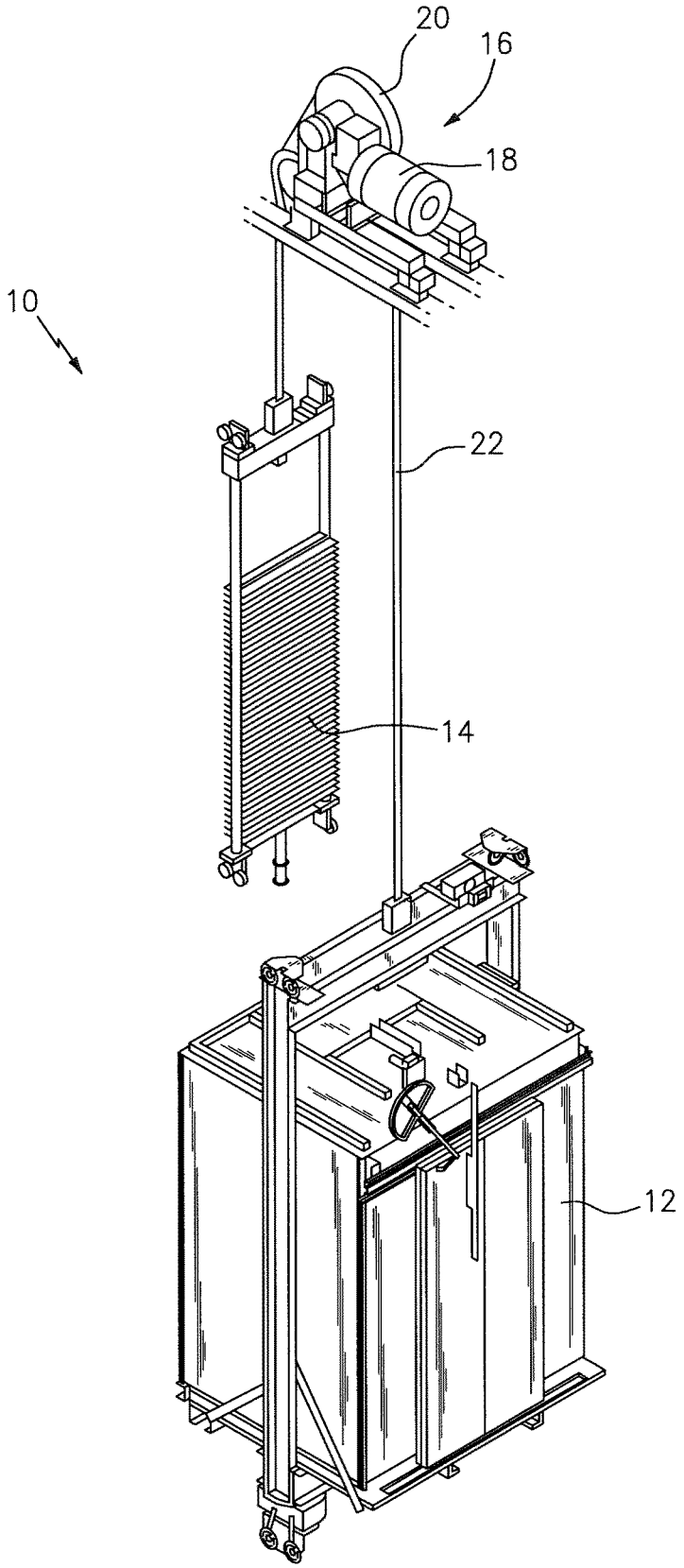
FIG. 1 is a diagrammatic illustration of a traction elevator system.

FIG. 1 illustrates an exemplary traction elevator system 10. The elevator system includes a car 12, a counterweight 14, a traction drive 16 including a machine 18 and a traction sheave 20, and a belt 22. The belt 22 is engaged with the traction sheave 20. Rotation of the sheave 20 by the machine 18 moves the belt 22, and thereby the car 12 and the counterweight 14. Although FIG. 1 shows an elevator system with a 1:1 roping arrangement, other elevator systems (e.g., with a 2:1 roping arrangement, etc.) could be used.

Figure 2:
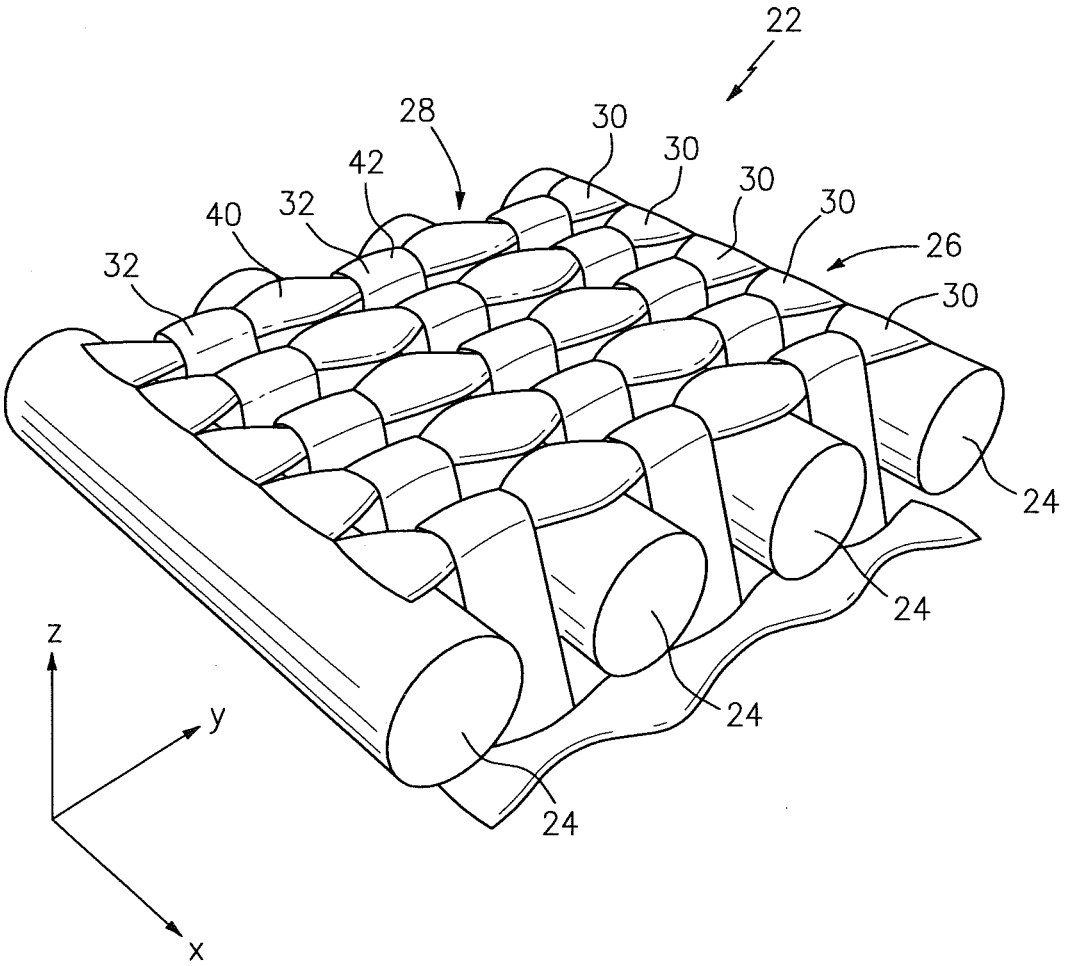
FIG. 2 is a diagrammatic perspective view of one embodiment of a belt.
Figure 3:
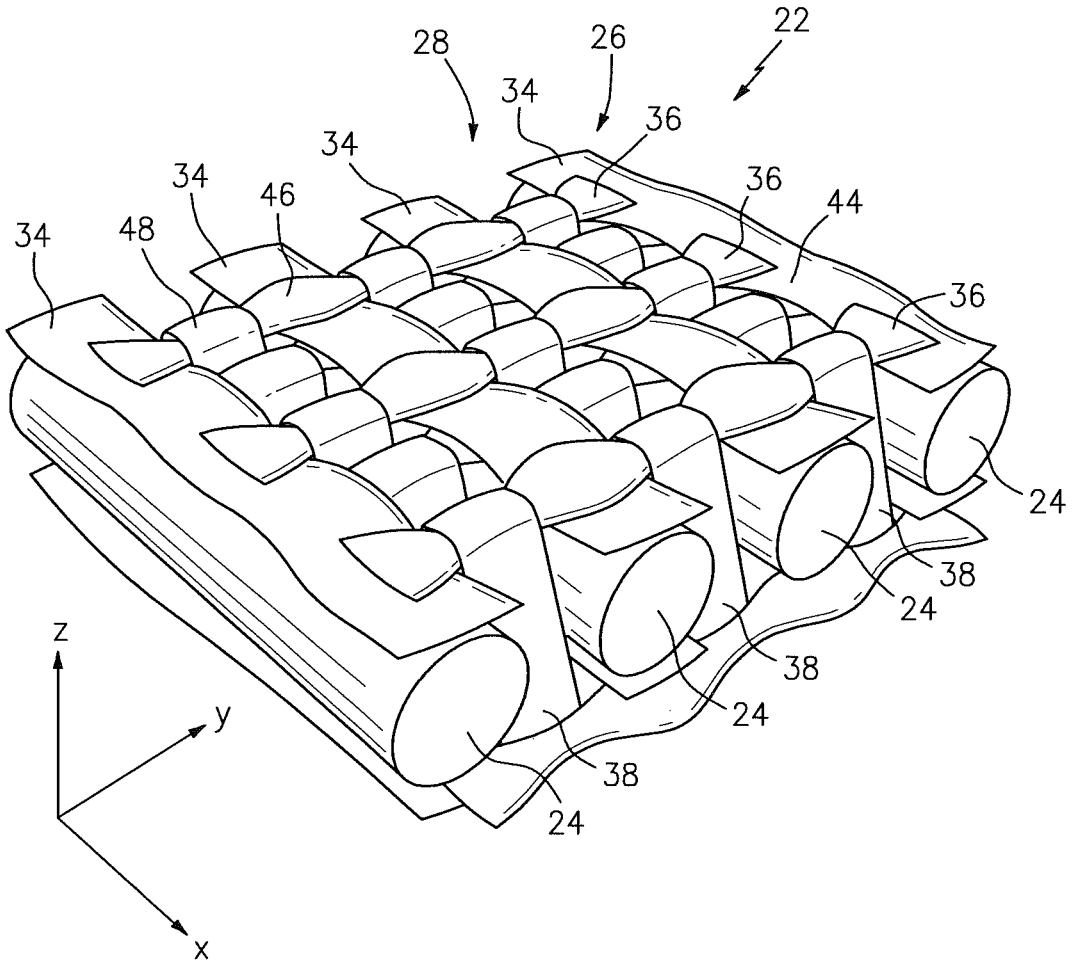
FIG. 3 is a diagrammatic perspective view of one embodiment of a belt.

FIGS. 2 and 3 illustrate several embodiments of the belt 22. In each of the embodiments illustrated in FIGS. 2 and 3, the belt 22 is defined by a length extending along an x-axis, a width extending along a y-axis, and a height extending along a z-axis. FIGS. 2 and 3 each illustrate the x-axis, the y-axis, and the z-axis. In each of the embodiments illustrated in FIGS. 2 and 3, the belt 22 includes a plurality of tension members 24, a jacket 26, and at least one exterior surface that is a traction surface 28. The tension members 24 are the primary load bearing structure of the belt 22. In the embodiments illustrated in FIGS. 2 and 3, the tensions members 24 are arranged generally parallel to each other and extend along the belt 22 in a lengthwise direction. As will be discussed in further detail below, the jacket 26 includes at least a plurality of first fibers and a plurality of second fibers, and the jacket is operable to substantially retain the tension members 24 in a desired position and orientation relative to each other. The phrase "substantially retain" means that the jacket 26 sufficiently engages the tension members 24 as enhanced by the plurality of fibers so that the tension members 24 do not pull out of the jacket 26 and remain substantially stationary relative to the jacket 26 under normal operating conditions. In the embodiments illustrated in FIGS. 2 and 3, the traction surface 28 of the belt 22 engages the traction sheave 20 of the elevator system 10 during use, and may additionally engage other sheaves of the elevator system (e.g., an idler sheave, a deflector sheave) during use.

In the embodiments illustrated in FIGS. 2 and 3, each tension member 24 is constructed from a plurality of wires (e.g., steel wires) formed into strands, the strands then formed into cords, and the cords then formed into the tension member 24. The tension members 24 may be constructed from a variety of different materials, and/or a combination of materials, including, for example, carbon steel, iron alloys, nickel alloys, aluminum alloys, or other ductile drawn metals which can be formed into wire. The tension members 24 may also be constructed of non-metallic fibers, such as aramid or vectran, or of any other material sufficiently strong and durable for use in elevator systems. In some embodiments, a coating may be applied to the surface of one or more of the tension members. The coating may provide corrosion resistance to the tension members, and/or the coating may protect the tensions members against wear caused by contact with a sheave. The coating is not limited to any particular material or composition; the coating may, for example, be a self-assembling organic or metal-organic coating. Coatings, and methods for applying coatings to the tension members, are known in the art and will not be discussed in detail herein.

The jacket includes at least a plurality of first fibers and a plurality of second fibers, the first and second fibers being distinguishable from one another based on at least one property, for example, a dimensional property, a mechanical property, or another property. Dimensional properties may include, for example, diameter of the fiber, or another dimensional property. Mechanical properties may include, for example, traction, tenacity, density, modulus, durability (e.g., ability to resist fretting and fraying), strength, or another mechanical property. The different types of fibers of the jacket (e.g., the first and second fibers) may be different types of yarn. The presently-disclosed embodiments are not limited to use with any particular type of yarn; e.g., the yarn may include continuous filaments, or may include a small amount of staple fiber added to the filaments. The yams may be made of any one of a number of drawn or oriented materials, including, for example, a polyester (e.g., PBT and/or PET), a polyamide (e.g., nylon), an aramid, a polyefin, or other materials. The yarns can include fluoropolymers or silicones for the purpose of reducing wear or chaffing of the tension members and/or the fibers. Yams are commonly distinguished from one another based on their tenacity (which is measured in centiNewtons/Tex, where a Tex is the S.I. unit of measure for the linear mass density of fibers in grams per 1000 meters) or their linear density (which is measured in Deniers, wherein a Denier is a measure for the linear mass density of fibers in grams per 9000 meters). The fibers of the jacket may be yarns having tenacities in the range of 50 cN/Tex to 80 cN/Tex, or linear densities in the range of 250 Denier to 4000 Denier. The fibers of the jacket need not be yarns; the fibers may alternatively be made of any other material operable to substantially retain the tension members. In some alternative embodiments not shown in the drawings, one or more of the fibers may be coated or impregnated with a material operable to bond the fibers together. The coating can be a flexible thermoplastic or curable material, including, for example, polyurethanes, polyesters, nylons, polyolefins, natural or synthetic rubber, or another acceptable material.

The fibers of the jacket may have any one of a number of configurations. FIGS. 2 and 3 each illustrate an embodiment of the belt 22, and each embodiment includes fibers of the jacket 26 in a different configuration. Each configuration will be discussed in more detail below. One or more of the fibers of the jacket may be described as being a "warp fiber" or a "weft fiber". The term "warp fiber" is used herein to describe fibers that extend along the belt 22 in a substantially lengthwise direction. Thus, a warp fiber may extend along a length of the belt substantially parallel to the tension members. Warp fibers may be, but need not be, threaded over and under weft fibers. The term "weft fiber" is used herein to describe fibers that extend along the belt in a widthwise direction. Weft fibers may be, but need not be, threaded over and under warp fibers or the tension members. The jacket includes some fibers that may be characterized as "fill fibers". The term "fill fibers" is used herein to describe fibers that extend along the belt in a lengthwise direction, and that are disposed between the tension members in such a way that they are not disposed between the tension members and the traction surface of the belt. Portions of each tension member or each fiber may be characterized as being either "exposed" or "covered". An exposed portion of a tension member or a fiber is one that defines an exterior surface of the belt. Conversely, a covered portion of a tension member or a fiber is one that does not establish an exterior surface of the belt. A tension member or a fiber may have some exposed portions and some covered portions. In some embodiments, the tension members may be entirely covered by the fibers of the jacket. In some embodiments, the tension members and the fibers of the jacket may be entirely covered by a coating, as described above.

As indicated above, the belt includes at least one exterior surface that is a traction surface. For example, in the embodiments illustrated in FIGS. 2 and 3, the traction surface 28 of the belt 22 engages the traction sheave 20 of the elevator system 10 during use. In the embodiments illustrated in FIGS. 2 and 3, the traction surface 28 is defined by exposed portions of the fibers of the jacket, as will be discussed further below. In some embodiments, some portions of the tension members proximate the traction surface may be exposed; however, in such embodiments the exposed portions of the tensions members preferably do not define a portion of the traction surface (and thus do not engage the traction sheave or any other sheave during use), because contact between the exposed portions of the tension members and the traction sheave may result in unwanted wear on the tension members. In embodiments in which a coating is applied to the tension members and/or the fibers of the jacket, the traction surface may be defined at least partially by the coating.

As indicated above, the jacket includes at least a plurality of first fibers and a plurality of second fibers, the first and second fibers being distinguishable from one another based on at least one property. The plurality of first fibers are at least partially disposed between the tension members and the traction surface of the belt, and the plurality of second fibers are fill fibers, or vice versa. The jacket may include other fibers (e.g., a plurality of third fibers) in addition to the plurality of first fibers and the plurality of second fibers. These other fibers may be at least partially disposed between the tension members and the traction surface of the belt, or may be fill fibers. In manufacturing the belt, the different types of fibers used in the jacket (e.g., the plurality of first fibers and the plurality of second fibers) may be selected in order to achieve one or more predetermined properties (e.g., a dimensional property, a mechanical property, etc.) of the belt. For example, in some instances it may be desirable to provide a belt having a predetermined tensile strength. In such instances, a plurality of first fibers having a first tensile strength and a plurality of second fibers having a second, different tensile strength may be selected so that the belt as a whole has the predetermined tensile strength. In some embodiments, the different types of fibers used in the jacket may be selected in order to achieve more than one predetermined property of the belt; e.g., the different types of fibers used in the jacket may be selected in order to achieve a predetermined tensile strength and a predetermined linear modulus of the belt as a whole. In some embodiments, the different types of fibers used in the jacket may be selected in order to achieve one or more predetermined properties of an exterior surface of the belt, including a traction surface of the belt, or an exterior surface of the belt that is not a traction surface (i.e., a non-traction surface of the belt). In some embodiments, the different types of fibers used in the jacket may be selected so that there is a substantially uniform contact pressure distribution across the belt, where it engages a traction sheave or another sheave. The phrase "substantially uniform contact pressure distribution" is used herein to mean that any given portion of the belt that is engaging a sheave experiences a contact pressure that is within a predetermined range of contact pressures; e.g., increased contact pressures experienced by a portion of the belt that is engaging a sheave, caused for example by ripples or fluctuations in the belt, are within a predetermined range of contact pressures. The range of contact pressures may, for example, include a predetermined mean contact pressure. This feature offers significant advantages over prior embodiments. In prior art embodiments, it was difficult to achieve substantially uniform contact pressure distribution across the belt where it engages a sheave; typically, contact pressure was significantly higher at portions of the traction surface proximate to each of the tension members. In presently-disclosed embodiments, because the different types of fibers used in the jacket may be selected to have different properties, a substantially uniform contact pressure distribution across is more easily achieved. By improving the uniformity of the contact pressure distribution across the belt where it engages a sheave, the durability of the belt is improved, and noise and/or vibration is reduced.

The above-described features of the presently-disclosed embodiments are also advantageous in that the cost of manufacturing the belt may be reduced. For example, in some prior art embodiments, it was necessary to provide an additional thermoplastic layer in the jacket in order to achieve a desired mechanical property (e.g., a desired contact pressure distribution) of the belt. The presently-disclosed embodiments reduce or eliminate the need for an additional thermoplastic layer in the jacket. The presently-disclosed embodiments can also reduce the overall cost of the fibers of the jacket. For example, it is possible to use a stronger, more expensive type of fiber in portions of the jacket where additional strength confers significant benefits (e.g., between the tension members and the traction surface of the belt), and a weaker, less expensive type of fiber in portions of the jacket where additional strength has little impact. The overall cost of such configurations may be less expensive than prior art embodiments which required use of the strong, more expensive type of fiber throughout the jacket.

EXAMPLE 1

FIG. 2 illustrates an exemplary embodiment of the belt 22. The jacket 26 of the belt 22 includes a plurality of first fibers 30 and a plurality of second fibers 32. The first fibers 30 are weft fibers that extend along the belt 22 in a widthwise direction. The first fibers 30 extend over and are in contact with a surface of the tension members 24. The first fibers 30 are not threaded over and under the tension members 24. Some portions of the first fibers 30 proximate the tension members 24 are exposed (e.g., the portion identified by reference element 40), whereas some portions (not visible in FIG. 2) are covered by the second fibers 32. The second fibers 32 are fill fibers that extend along the belt 22 in a lengthwise direction. As shown in FIG. 2, the second fibers 32 are disposed between the tension members 24. Some portions of the second fibers are exposed (e.g., the portion identified by reference element 42), whereas other portions (not visible in FIG. 2) are covered by the first fibers 30. In the embodiment illustrated in FIG. 2, the traction surface 28 of the belt 22 is defined by the exposed portions of the first fibers 30, and the exposed portions of the second fibers 32. Some portions of the tension members 24 are not covered by the first fibers 30, and thus are exposed. However, the traction surface 28 is not defined by the exposed portions of the tension members 24; i.e., the exposed portions of the tension members 24 do not contact a sheave during use. Although exposed portions of the first fibers 30 help define the traction surface 28, the first fibers 30 may also be described as being disposed between the tension members 24 and the traction surface 28. This is in contrast to the second fibers 32 (i.e., the fill fibers), which extend along the belt 22 in a lengthwise direction, and which are disposed between the tension members 24, and which are not disposed between the tension members 24 and the traction surface 28.

In the embodiment illustrated in FIG. 2, the first and second fibers 30, 32 are both yarns. The tenacity and linear density of the first fibers 30 are higher than the tenacity and linear density of the second fibers 32. The first fibers 30 are more expensive than the second fibers 32; however, the overall cost of manufacturing the belt 22 is lower than if the second fibers 32 were the same type of fibers as the first fibers 30. Because the first fibers 30 have relatively high tenacity and linear density, and because the exposed portions of the first fibers 30 define portions of the traction surface 28 proximate the tension members 24, the belt 22 has a more uniform contact pressure distribution across the traction surface 28 as compared to prior art belts (which may not, for example, include high tenacity and high linear density fibers defining portions of the traction surface proximate the tension members).

EXAMPLE 2

FIG. 3 illustrates another exemplary embodiment of the belt 22. In FIG. 3, the jacket 26 of the belt 22 includes a plurality of first fibers 34, a plurality of second fibers 36, and a plurality of third fibers 38. The first fibers 34 are warp fibers that extend along the belt 22 in a lengthwise direction and contact a surface of the tension members 24. The second fibers 36 are weft fibers that extend along the belt 22 in a widthwise direction. The second fibers 36 extend over and contact the first fibers 34. The second fibers 36 are not threaded over and under the tension members 24 or the first fibers 34. The third fibers 38 are fill fibers that extend along the belt 22 in a lengthwise direction, substantially parallel to the tension members 24 and the first fibers 34. As shown in FIG. 3, the third fibers 38 are disposed between the tension members 24. Some portions of the first fibers 34 are exposed (e.g., the portion identified by reference element 44), whereas some portions (not visible in FIG. 3) are covered by the second fibers 36. Some portions of the second fibers 36 proximate the tension members are exposed (e.g., the portion identified by reference element 46), whereas some portions (not visible in FIG. 3) are covered by the third fibers 38. Some portions of the third fibers 38 are exposed (e.g., the portion identified by reference element 48), whereas other portions (not visible in FIG. 3) are covered by the second fibers. In the embodiment of FIG. 3, the tension members 24 are entirely covered by the first and second fibers 34, 36. Thus, the traction surface 28 of the belt 22 is defined by the exposed portions of the first fibers 34, the exposed portions of the second fibers 36, and the exposed portions of the third fibers 38. Although the exposed portions of the first and second fibers 34, 36 help define the traction surface 28, the first and second fibers 34, 36 may also be described as being disposed between tension members 24 and the traction surface 28. This is in contrast to the third fibers 38 (i.e., the fill fibers), which extend along the belt 22 in a lengthwise direction, and which are disposed between the tension members 24, and which are not disposed between the tension members 24 and the traction surface 28.

In the embodiment illustrated in FIG. 3, the second and third fibers 36, 38 are the same as the first and secondary fibers 30, 32 illustrated in FIG. 2, respectively. The tenacity and linear density of the third fibers 38 are lower than those of the first and second fibers 34, 36. Because the tension members 24 are entirely covered by the first and second fibers 34, 36, the belt 22 has a more uniform contact pressure distribution across the traction surface 28 as compared to the belt 22 illustrated in FIG. 2.

While various embodiments of the present invention have been disclosed, it will be apparent to those of ordinary skill in the art that many more embodiments and implementations are possible within the scope of the invention. Accordingly, the present invention is not to be restricted except in light of the attached claims and their equivalents.

What is claimed is:

1. A belt for an elevator system, comprising:

a plurality of tension members that extend along a length of the belt; and a jacket substantially retaining the plurality of tension members, the jacket comprising a plurality of first fibers, a plurality of second fibers, and a plurality of third fibers, and the jacket defining at least one exterior, traction surface of the belt;

wherein the first fibers are weft fibers that are at least partially disposed between the tension members and the traction surface of the belt;

wherein the second fibers are fill fibers that are at least partially disposed between the tension members; and wherein the third fibers are warp fibers that are at least partially disposed between the tension members and the traction surface of the belt.

2. The belt of claim 1, wherein the first fibers have at least one property that distinguishes them from the second fibers, and wherein the at least one property is included in a group of mechanical properties consisting of: tenacity, linear density, linear modulus, durability.

3. The belt of claim 1, wherein the tenacity or linear density of the first fibers is greater than the tenacity or linear density of the second fibers, respectively.

4. The belt of claim 1, wherein the first fibers have at least one property that distinguishes them from the second fibers, and wherein the at least one property is the diameter of the first fibers.

5. The belt of claim 1, wherein the first fibers have at least one property that distinguishes them from the second fibers, and wherein the at least one property provides the belt with a property that is included in a group consisting of: dimensions, density, strength, modulus, traction, durability and performance.

6. The belt of claim 1, wherein the jacket totally covers the plurality of tension members.

7. The belt of claim 1, wherein the traction surface of the belt is defined by exposed portions of the first fibers and exposed portions of the second fibers.

8. The belt of claim 2, wherein a pressure distribution on the traction surface of the belt is substantially uniform when the belt engages a sheave of the elevator system.

9. The belt of claim 1, wherein an orientation of one of the first fibers or the second fibers relative to the tension members is provided so that a pressure distribution on the traction surface of the belt is substantially uniform when the belt engages a sheave of the elevator system.

10. The belt of claim 1, wherein the first fibers or the second fibers are yarns.

11. The belt of claim 10, wherein at least one of the first fibers or the second fibers are made from a material included in a group consisting of: a polyester, a polyamide, an aramid, a polyolefin.

12. The belt of claim 1, wherein the second fibers extend along the tension member in a lengthwise direction, and are not disposed between the tension members and the traction surface.

13. The belt of claim 5, wherein the at least one property relates to an exterior surface of the belt.

14. The belt of claim 13, wherein the exterior surface of the belt is the traction surface of the belt.

15. The belt of claim 13, wherein the exterior surface of the belt comprises a non-traction surface of the belt.

16. The belt of claim 6, wherein collectively the first fibers, the second fibers, and the third fibers substantially totally cover the plurality of tension members.

17. The belt of claim 1, wherein the third fibers are completely disposed between the tension members and the traction surface of the belt.

* * * * *